US009181759B1

(12) United States Patent
Yusuf

(10) Patent No.: US 9,181,759 B1
(45) Date of Patent: Nov. 10, 2015

(54) METHOD AND APPARATUS FOR INCREASING LOAD BEARING CAPACITY OF A TUBULAR STRING

(71) Applicant: Osman Yusuf, Austin, TX (US)

(72) Inventor: Osman Yusuf, Austin, TX (US)

( * ) Notice: Subject to any disclaimer, the term of this patent is extended or adjusted under 35 U.S.C. 154(b) by 0 days.

(21) Appl. No.: 14/587,509

(22) Filed: Dec. 31, 2014

Related U.S. Application Data

(60) Provisional application No. 62/028,878, filed on Jul. 25, 2014.

(51) Int. Cl.

| | |
|---|---|
| ***E21B 17/00*** | (2006.01) |
| ***E21B 17/10*** | (2006.01) |
| ***E21B 33/14*** | (2006.01) |
| ***E21B 23/01*** | (2006.01) |

(52) U.S. Cl.
CPC ..... *E21B 17/1021* (2013.01); *E21B 23/01* (2013.01); *E21B 33/14* (2013.01)

(58) Field of Classification Search
CPC ..... E21B 33/13; E21B 33/134; E21B 33/14; E21B 23/01; E21B 17/1021; E21B 17/1078; E21B 17/1014; E21B 4/18; E21B 10/32
USPC ..... 52/153, 154, 158–160
See application file for complete search history.

(56) References Cited

U.S. PATENT DOCUMENTS

| | | | | |
|---|---|---|---|---|
| 1,982,687 | A * | 12/1934 | O'Brien | 405/257 |
| 3,570,603 | A * | 3/1971 | Kammerer et al. | 166/290 |
| 3,709,188 | A * | 1/1973 | Coupar | 52/163 |
| 3,912,006 | A * | 10/1975 | Nutter | 166/216 |
| 4,276,932 | A | 7/1981 | Saliger et al. | |
| 4,848,490 | A | 7/1989 | Anderson | |
| 6,899,183 | B2 | 5/2005 | Dewey et al. | |
| 7,306,033 | B2 | 12/2007 | Gorrara | |
| 7,314,099 | B2 | 1/2008 | Dewey et al. | |
| 7,878,241 | B2 | 2/2011 | Buytaert et al. | |
| 8,020,625 | B2 | 9/2011 | Ring et al. | |
| 8,448,722 | B2 | 5/2013 | Konschuh et al. | |
| 2004/0238218 | A1 * | 12/2004 | Runia et al. | 175/57 |
| 2009/0025929 | A1 | 1/2009 | Buytaert et al. | |
| 2010/0139649 | A1 * | 6/2010 | Almy et al. | 126/704 |
| 2012/0152565 | A1 | 6/2012 | Bennett et al. | |

* cited by examiner

*Primary Examiner* — Robert E Fuller
*Assistant Examiner* — Steven MacDonald
(74) *Attorney, Agent, or Firm* — Sam Sokhansanj, Esq.

(57) ABSTRACT

An apparatus for increasing a load bearing capacity of a tubular string having a first body coupled to the string, two or more members coupled to the first body, and wherein the two or more members are configured to move with respect to the first body. The two or more members each further include a distal end having one or more of an acute, pointed, tapered, or sharp configuration. In addition, a second body is configured to cause the two or more members of the first body to move radially outwardly, wherein the distal ends of the two or more parts penetrate the earth and thereby increase the load bearing capacity of the tubular string.

4 Claims, 8 Drawing Sheets

METHOD AND APPARATUS FOR INCREASING LOAD BEARING CAPACITY OF A TUBULAR STRING

CROSS REFERENCE TO RELATED APPLICATIONS

This application claims the benefit of U.S. Provisional Application No. 62/028,878 filed on Jul. 25, 2014, which is incorporated herein by reference in its entirety.

FIELD OF INVENTION

The present document is generally related to an apparatus for and method of increasing the load-bearing capacity of a tubular string (referred to herein as "Load-Bearing Capacity Increaser" or "LBCI"), and more particularly an apparatus, system and/or method of increasing load-bearing capacity of a tubular pipe or string used in the construction of a well.

BACKGROUND

This section is intended to introduce the reader to aspects of art that may be related to various aspects of the present invention or present solution, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

During the construction of a well, particularly oil and gas wells, tubular pipe, which is also known as a joint, conductor pipe, conductor casing, casing, and/or tubing, are joined together to create a "string", which is a long section of connected tubular pipe that is lowered into a wellbore and eventually serves as the foundation and production conduit for the well. The most common and traditional method for placing a tubular string into the earth involves drilling and creating a borehole in the earth and placing and cementing the tubular in the borehole to the earth. Other traditionally prevailing methods for placing a tubular string in the earth include jetting and piling, although these methods are typically only for the first and uppermost tubular string in a well. This first and uppermost tubular string is also called the conductor string, conductor casing string, conductor casing, conductor pipe or drive pipe. This section of the well is known as the top-hole section. Specifically referring to the top-hole section, the conductor string plays a very critical role in the further drilling, construction, foundation, and short and long term integrity of the well, in that along with serving as the initial foundation, permanent structure, and outermost connection to the wellhead and/or blowout preventer of the well, it must bear significant loads during each and every phase in the life of the well, which includes drilling, construction, and the production operation.

These loads can include the weight of the conductor string itself, drilling and production risers, wellhead, blowout preventer, casing strings, platform structure, and other various drilling and production operational equipment. When placing the conductor string into the earth using the aforementioned traditionally prevailing methods, conductor strings generally appear to provide adequate load-bearing capacity for the aforementioned operational equipment, although from time to time it is also common even in these traditional methods for conductor strings to sink after they are initially set, in some cases occurring immediately to during the drilling and well construction process up to decades later during production or even abandonment, always due to inadequate load-bearing capacity. As drilling depths increase, more complex and heavier operational equipment, especially wellheads, blowout preventers, and casing strings are being employed. Also, referring to well design, with the proliferation of directional drilling, non-vertical, extended reach, horizontal, slant and or angled wells are becoming more common requiring an early or shallow drilling bit exit from the top-hole conductor string bottom or shoe. This early or shallow drilling bit exit is required in order to begin to build angle in the subsequent borehole for the eventual reach of the intended target, which could only be reached due to this early angle build due to a maximum allowable inclination, bend or slant due to equipment limitations. Specifically referring to the early or shallow drilling bit exit from the top-hole conductor string bottom or shoe, this may limit the conductor string total length and depth in the earth, as a predetermined top-hole conductor string setting depth, total depth, or shoe point becomes a priority and takes precedence over a deeper more adequate setting depth to ensure proper load-bearing capacity.

Also, in some instances, unforeseen and/or unique circumstances involving formation, formation plasticity, formation set-up, cement job, cement composition, cement bond, conductor pipe, conductor pipe bond, connectors, assemblies, and other down-hole variables may cause inadequate load-bearing capacity in a conductor string. For example, formation set-up is a direct function of time in that the greater the time a tubular pipe or string remains in undisturbed contact with the earth, the greater the load-bearing capacity of said tubular string. This varies depending on multiple factors, mainly formation plasticity, but typical well construction procedures do not allow time for a tubular pipe or string remaining in undisturbed contact with the earth after placement mainly due to the economics of the practice. As a result down time or non-productive time costs associated with the practice would be realized in such a case, as further drilling operations must be halted to keep the tubular pipe or string in undisturbed contact with the earth. These costs can include but are not limited to drilling rig day rates, other daily spread costs and opportunity costs associated with late delivery of well production. An additional outlying reason includes the impossibility to calculate set-up effects on load-bearing capacity due to multiple unique factors associated with each and every well design and the area geology, which can vary even on wells drilled on the same exact platform only feet apart. Consequently, there exists a lack of expertise in the practice.

Hence, what is needed is an apparatus, system and/or method for increasing the load-bearing capacity of a tubular pipe or string that can be quickly deployed and is cost effective.

BRIEF SUMMARY OF THE INVENTION

The present invention addresses the deficiencies and shortfalls of the aforementioned systems and methods. Particularly, in one embodiment, a load-bearing capacity increaser ("LBCI") apparatus can be installed and coupled to a tubular pipe or string or within the tubular pipe or string. In addition, multiple LBCI apparatuses can be installed and coupled to a single tubular pipe or string or within a single tubular pipe or string. For example, the LBCI apparatuses can be located at the very top, in between, or at the very bottom of the string, which can be placed in the earth using any of the traditional methods of placing a tubular pipe or string in the earth (drilling and cementing, jetting or piling). Once the tubular string and apparatus have been placed in the earth, the apparatus can be activated, thereby increasing its diameter, which will increase the load bearing capacity of the tubular pipe or string and also the overall well or borehole. In another embodiment, a method is provided for preparing and drilling the borehole and cementing the tubular pipe or string in the earth, either with or without the conjunction of the apparatus of the present invention, which can be employed to increase the load bearing capacity of the tubular pipe or string.

In the described embodiments, the process of increasing the load-bearing capacity of the tubular pipe or conductor casing string is achieved by use of the earth as a hanger point for which the tubular pipe or string load-bearing capacity is increased by means of hanging or holding by the LBCI apparatus after it has been set, which creates an outwardly protruding end or ledge from the apparatus body thereby penetrating the earth, cement, or both. In one embodiment, the LBCI apparatus can maintain a minimum outside diameter in the un-set position, ideally substantially flush with the outside diameter of the tubular pipe or string in order to effectively reach total depth as easily as possible by minimizing obstructions in the borehole or earth. Once the LBCI apparatus is set, the apparatus' diameter will generally increase and be larger than the outside diameter than the tubular pipe being employed.

In one aspect of the invention, an apparatus is provided for placement at the top of a tubular pipe or string. Here, the placement of the LBCI apparatus can be anywhere along the body of the tubular pipe or string. In addition, the placement of the apparatus can be at the bottom of the tubular pipe or string. The apparatus can be secured to a tubular pipe or string using connectors. Further, the apparatus can be secured to a tubular pipe or string by means of welding. The apparatus outside diameter can be flush or the same or substantially same as the outside diameter of the tubular pipe or string being employed. Alternatively, the outside diameter can be semi-flush or at least partially larger or smaller than the outside diameter of the tubular pipe or string being employed. Alternatively, the apparatus outside diameter may not be the same diameter as the outside diameter of the tubular pipe or string being employed. The apparatus inside diameter can be flush or the same as the inside diameter of the tubular pipe or string being employed. The apparatus inside diameter can be semi-flush or at least partially larger or smaller with respect to the inside diameter of the tubular pipe or string being employed. Alternatively, the apparatus inside diameter may not be flush or the same with the inside diameter tubular pipe or string being employed.

In one aspect of the invention, the apparatus is set using a setting spear, expander, or mandrel intended to be run through the inside diameter of the tubular pipe or string after it has been placed in the earth in jetting and piling applications or after it has been placed in the borehole in drilling and cementing applications. Here, the setting spear may be run on tubular pipe, drill pipe, work string, wire or slick line, or coiled tubing. When using a tubular, work or drill string, the placement of the setting spear can be anywhere along the body of the string. In addition, the placement of the setting spear can be at the bottom of the string. The setting spear can be secured to the string using connectors. Further, the setting spear can be secured to a string by means of welding. Also the setting spear can be run in conjunction with a bottom hole assembly, for example above the drill bit, to set the apparatus and drill the subsequent borehole in one trip so to minimize the trips required to set the apparatus and drill the subsequent borehole, eventually reducing time spent achieving the setting task.

In another aspect of the present invention, a load-bearing capacity increaser assembly is provided for providing an increase in the load-bearing capacity of a tubular pipe or string including a plurality of internal gussets, an internal cone, a plurality of internal spears, a plurality of external spears, an external skirt, and an external upset.

In another aspect of the present invention, a method of deploying a load-bearing capacity increaser assembly can be installed on a tubular string in the un-set configuration, and deployable within the borehole to provide an increase in the load-bearing capacity of a tubular pipe or string, wherein the method can include reshaping the apparatus within the targeted interval of the borehole to create an upset or right angle greater than the outside diameter of the tubular pipe or string and greater than the inside diameter of the borehole, in effect setting the apparatus within said targeted interval of the borehole.

In another aspect of the present invention, a method of deploying a load-bearing capacity increaser assembly can be installed on a tubular string in the un-set configuration, and deployable within the borehole to provide an increase in the load-bearing capacity of a tubular pipe or string, wherein the method can include pushing the internal spears outwardly through the apparatus into the earth past the inside diameter of the borehole, in effect setting the apparatus within the targeted interval of the borehole.

In another aspect of the present invention, a method of deploying a load-bearing capacity increaser assembly can be installed on a tubular string in the un-set configuration, and deployable within the borehole to provide an increase in the load-bearing capacity of a tubular pipe or string, wherein the method can include opening the external spears or skirt outwardly from the tubular pipe or string into the earth past the inside diameter of the borehole, in effect setting the apparatus within the targeted interval of the borehole.

In another aspect of the present invention, an apparatus is provided for increasing the load bearing capacity of a tubular string having a first body coupled to the string, two or more members coupled to the first body, wherein the two or more members are configured to move with respect to the first body, the two or more members each further include a distal end having one or more of an acute, pointed, tapered, or sharp configuration, and a second body configured to cause the two or more members of the first body to move radially outwardly, wherein the distal ends of the two or more members penetrate the earth. In addition, the two or more members can be comprised of one or more of blades, fins, wings, spearheads, and rods. Further, the two or more members can expand the diameter of the first body. The two or more members may also pivot with respect to the first body. The two or more may also include an inverted cone or gussets configured to expand radially outward.

In another aspect of the present invention, a method of increasing the load bearing capacity of a tubular string can include positioning a first body coupled to the string within a borehole, wherein the first body includes a plurality of members for penetrating the earth, the members having a distal end with a tapered configuration, and positioning a second body through the string and adjacent to the second body, wherein the second body at least partially engages the first body, thereby causing the members to move with respect to the first body and penetrate the earth, thereby increasing the load bearing capacity of the string. Further, the earth penetrated engaged members of the first body provide space between the first body and the earth thereby allowing fluid to pass through the borehole around the string. The method can further include jetting or piling the string into the earth prior to the parts of the first body having penetrated the earth. The method can also include cementing the string in the borehole after the parts of the first body have penetrated the earth.

The above summary is not intended to describe each and every disclosed embodiment or every implementation of the disclosure. The description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

While preferred embodiments of the LBCI have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention.

Figure 1A:
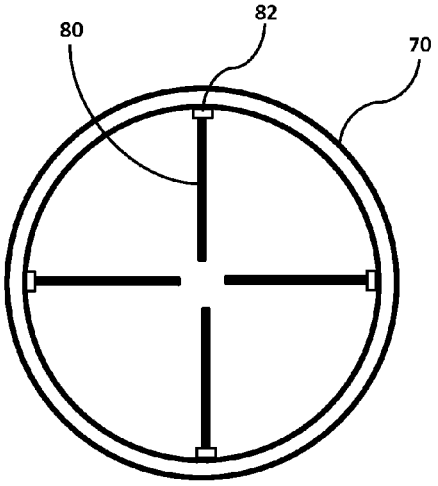
FIG. 1A illustrates a top view for one non-limiting embodiment of a LBCI apparatus of the present invention.
Figure 1B:
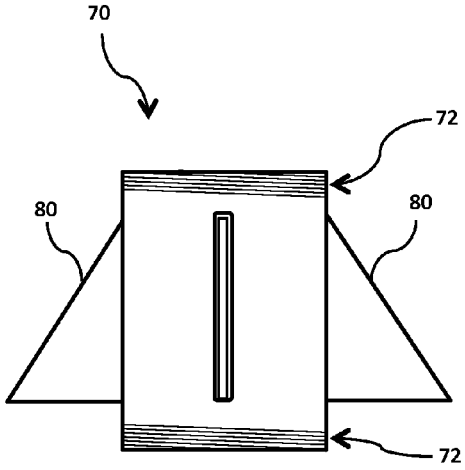
FIG. 1B illustrates a side view for the LBCI apparatus of FIG. 1A.
Figure 1C:
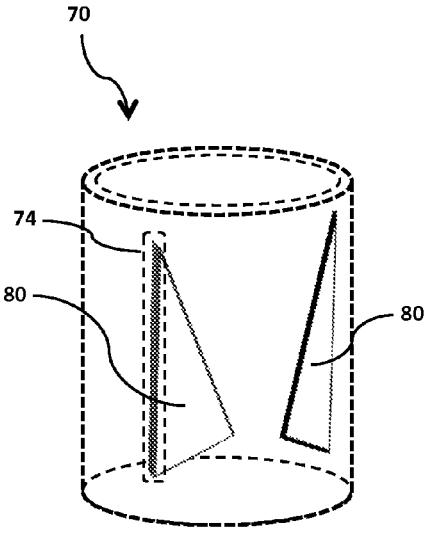
FIG. 1C illustrates a perspective view of the LBCI apparatus of FIG. 1A, shown in an inactive or un-set position.
Figure 1D:
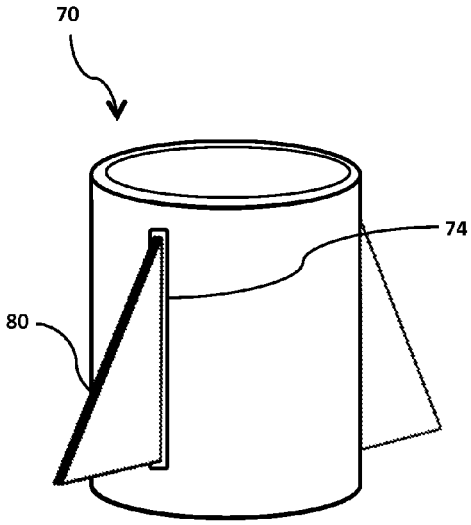
FIG. 1D illustrates a perspective view of the LBCI apparatus of FIG. 1A, shown in an activated or set position.

FIG. 1A-1D illustrate various views for one embodiment of the LBCI apparatus of the present invention. Here, LBCI apparatus 70 can include a plurality of parts or members 80, which can also be referred to herein as blades, fins, wings, spears, protrusions, projectiles, gussets, among others. Here, parts 80 can be disposed within the interior volumetric space of the LBCI apparatus 70, as shown in FIG. 1A and FIG. 1C. Further, members 80 can pivot about a hinge 82 thereby projecting or protruding outwards, as shown in FIG. 1B and FIG. 1D. Alternatively, members 80 can project or protrude outwards along a horizontal plane axis in a linear or non-linear movement or trajectory. Further, LBCI apparatus 70 may also include a plurality of sealed openings 74 that allow members 80 to protrude outwards from the body of apparatus 70. In addition, the openings 74 will provide a seal from along the perimeter of parts 80, whether protruding or within the interior body of apparatus 70, thereby preventing backflow or other material/fluids from entering the apparatus 70 and/or the conductor string through the openings. Alternatively, openings 74 may also be perforations that break or rupture when the members 80 are activated (set) to protrude outwards, but still maintaining a seal around the perimeter of members 80. LBCI apparatus 70 may also include threads or fastening junctions 72 either on its outer or inner body, thereby allowing it to couple, fasten, integrate, secure to or within a tubular conductor string or pipe, such as string 30 (FIG. 1E-4A).

Figure 1E:
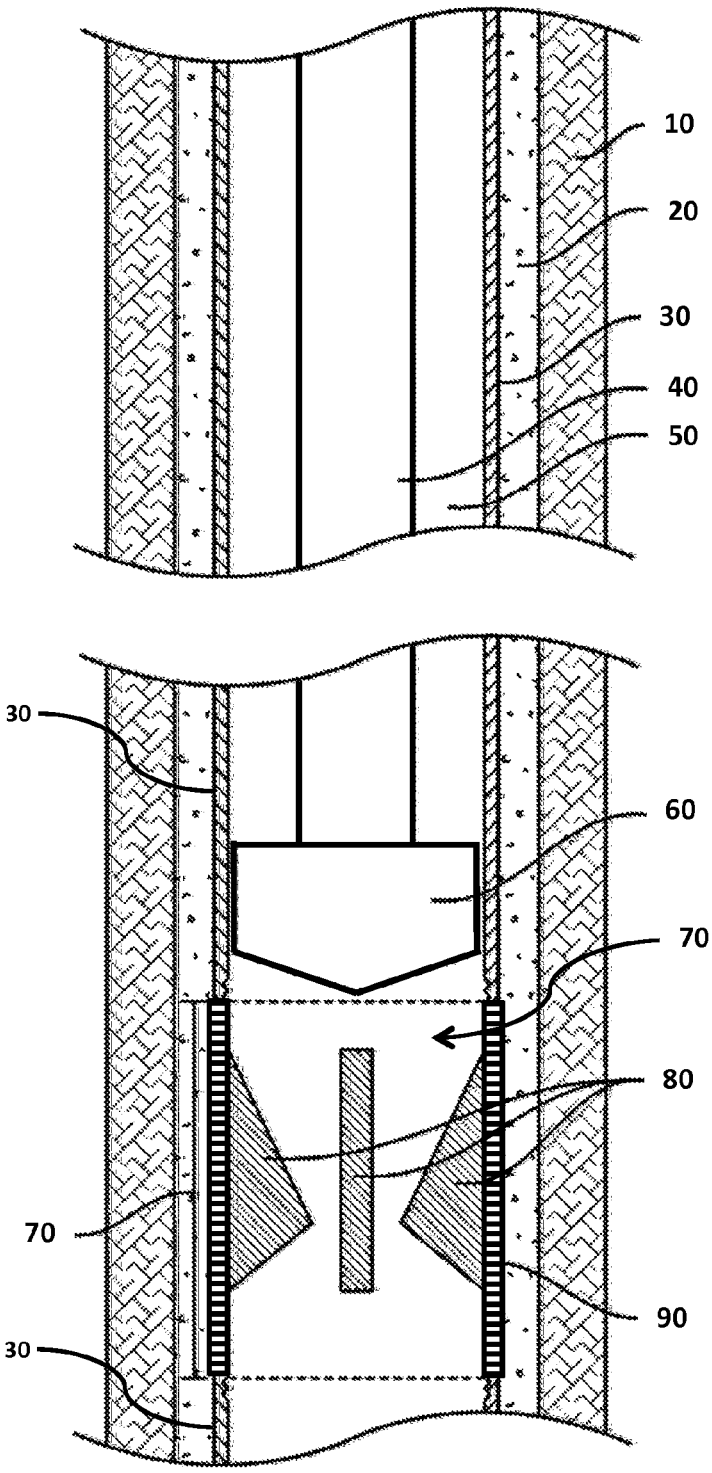
FIG. 1E illustrates a cross sectional side view of one non-limiting embodiment for a conductor string positioned in an open borehole prior it to being cemented in place and having the LBCI apparatus within the borehole, further shown prior to the LBCI apparatus being activated by an activator head or mandrel.

Referring initially to FIG. 1E, an embodiment of the LBCI apparatus 70 is shown for open borehole or drilling, running and cementing applications, wherein the LBCI apparatus 70 is shown in an inactive or un-set state or position having the plurality of members 80. In one embodiment, the LBCI apparatus 70 is coupled or secured to the conductor string 30, such as in between upper and lower section of the string 30, and lowered and positioned into the open borehole 20, wherein the string 30 and apparatus 70 have a space or gap between them and the earth 10 within the open borehole 20. The conductor string 30 can be positioned at total depth and can remain stationary in the open borehole 20 which may or may not be cemented in place yet. Prior to or after cementation, an elongated activator head, setter, mandrel, or spear 60 is lowered via an elongated arm or drill pipe 40 through the inside diameter 50 of the conductor string 30 and is at least partially positioned or suspended above the in-activated or un-set LBCI apparatus 70 or subsequently driven through the apparatus 70 to activate it.

Figure 1F:
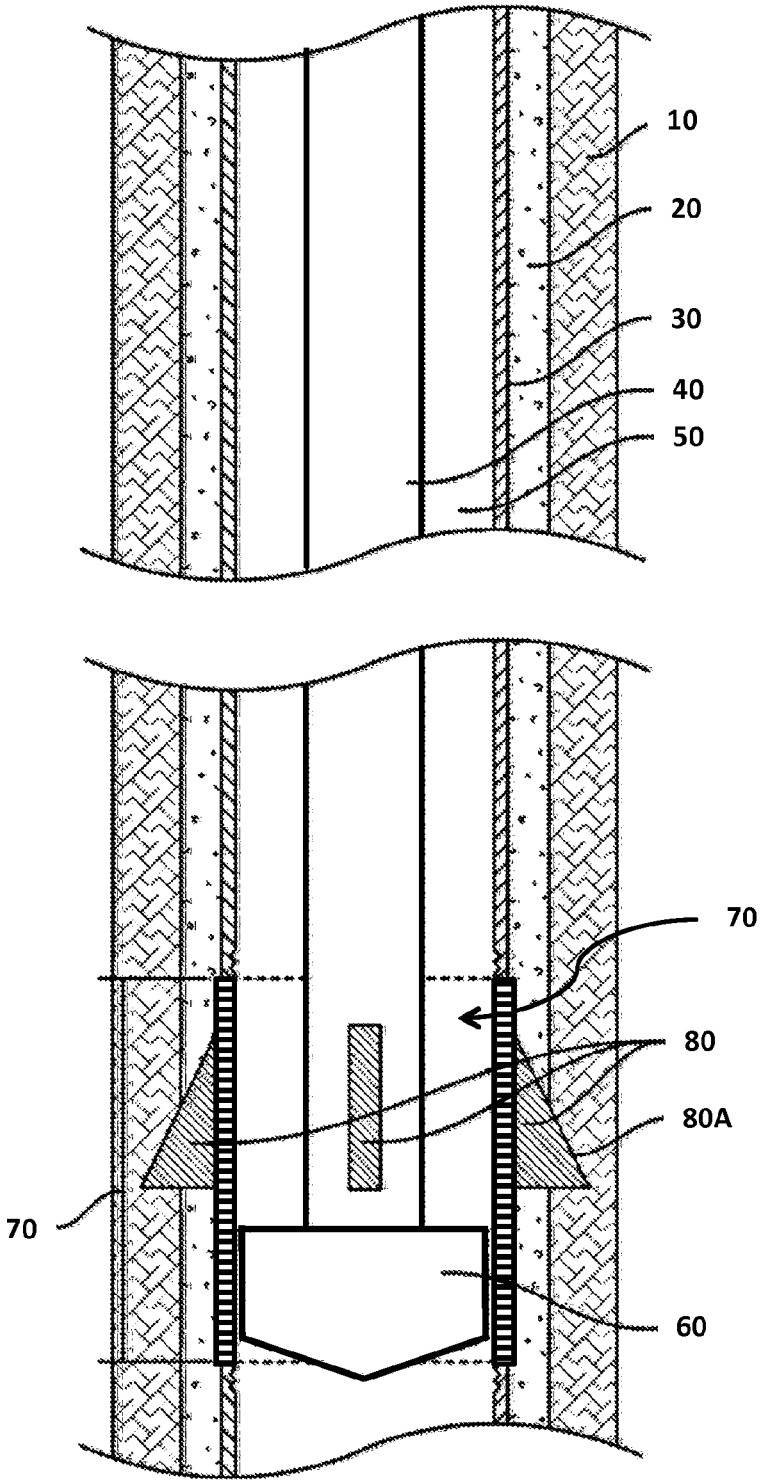
FIG. 1F illustrates a cross sectional side view of the embodiment of FIG. 1E, shown after the activator head or mandrel has activated the LBCI apparatus.

FIG. 1F illustrates the LBCI apparatus 70 after it has been activated by activator head 60. Specifically, the projecting members 80 of LBCI apparatus are activated or set after engaging, pushing, pumping, actuating, sliding, rotating, or forcing the LBCI activator head 60 through the LBCI apparatus 70, wherein the head 60 makes contact, engages, and pushes or forces the members 80 to project radially outwards, as shown in FIG. 1F, thereby placing the LBCI apparatus 70 in an activated or set position or state, as shown by numeral 80A. In the activated position 80A, the members 80 can reshape or expand the size of apparatus 70. More specifically, when activated, the sharp, tapered, or acute distal ends of members 80 penetrate or pierce deep into the sides of the earth 10 thereby stabilizing, securing, and increasing the load bearing capacity of string 30. The fin, fan, thin, or blade-like cross section of members 80, in an activated position, still allow the flow of fluid passage, cement, slurry, grime, and gases between to pass through the apparatus 70 and also in between the string 30 and borehole 20.

Figure 2A:
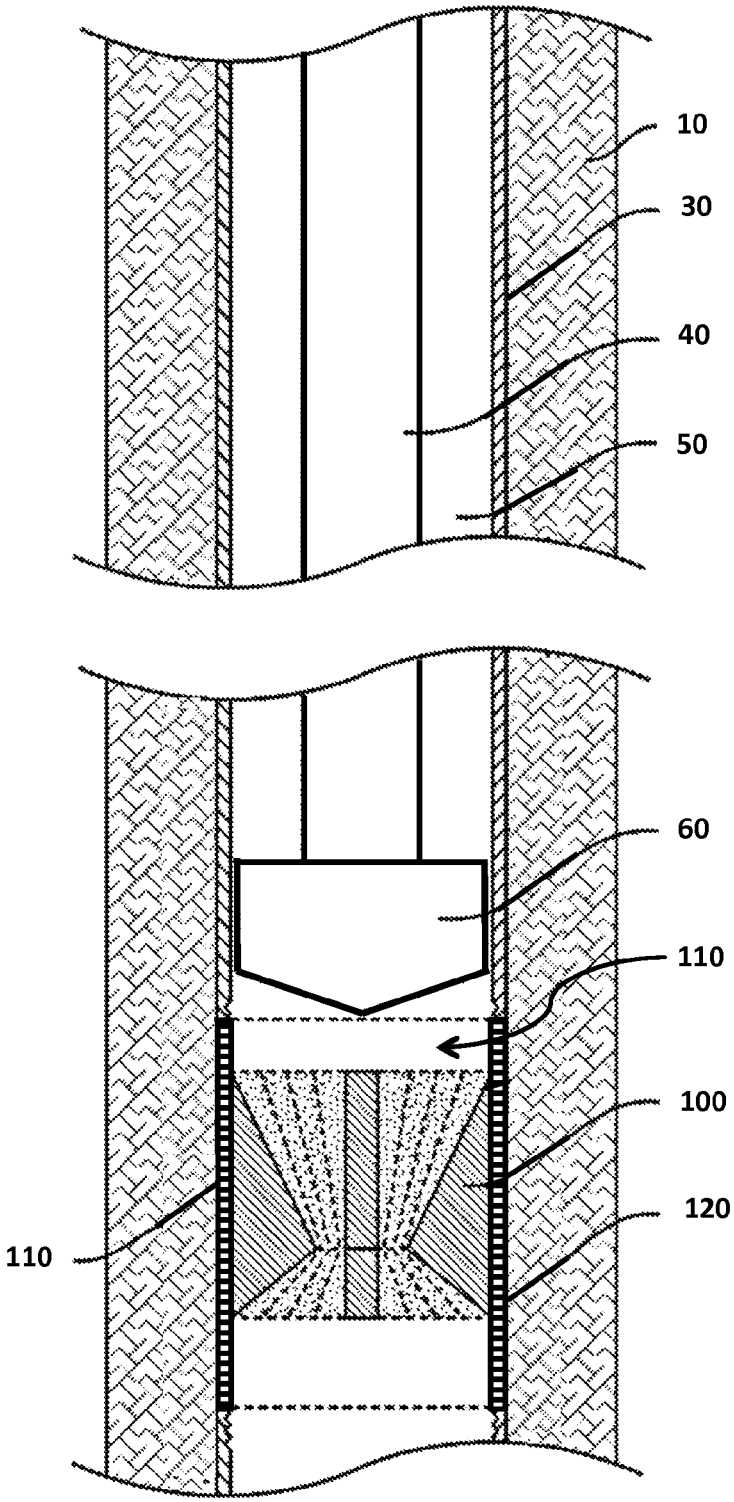
FIG. 2A illustrates a cross sectional side view of another non-limiting embodiment for a conductor string positioned and installed by way of jetting or piling, and having another embodiment of an LBCI apparatus, further shown prior to the LBCI apparatus being activated by an activator head or mandrel.
Figure 2B:
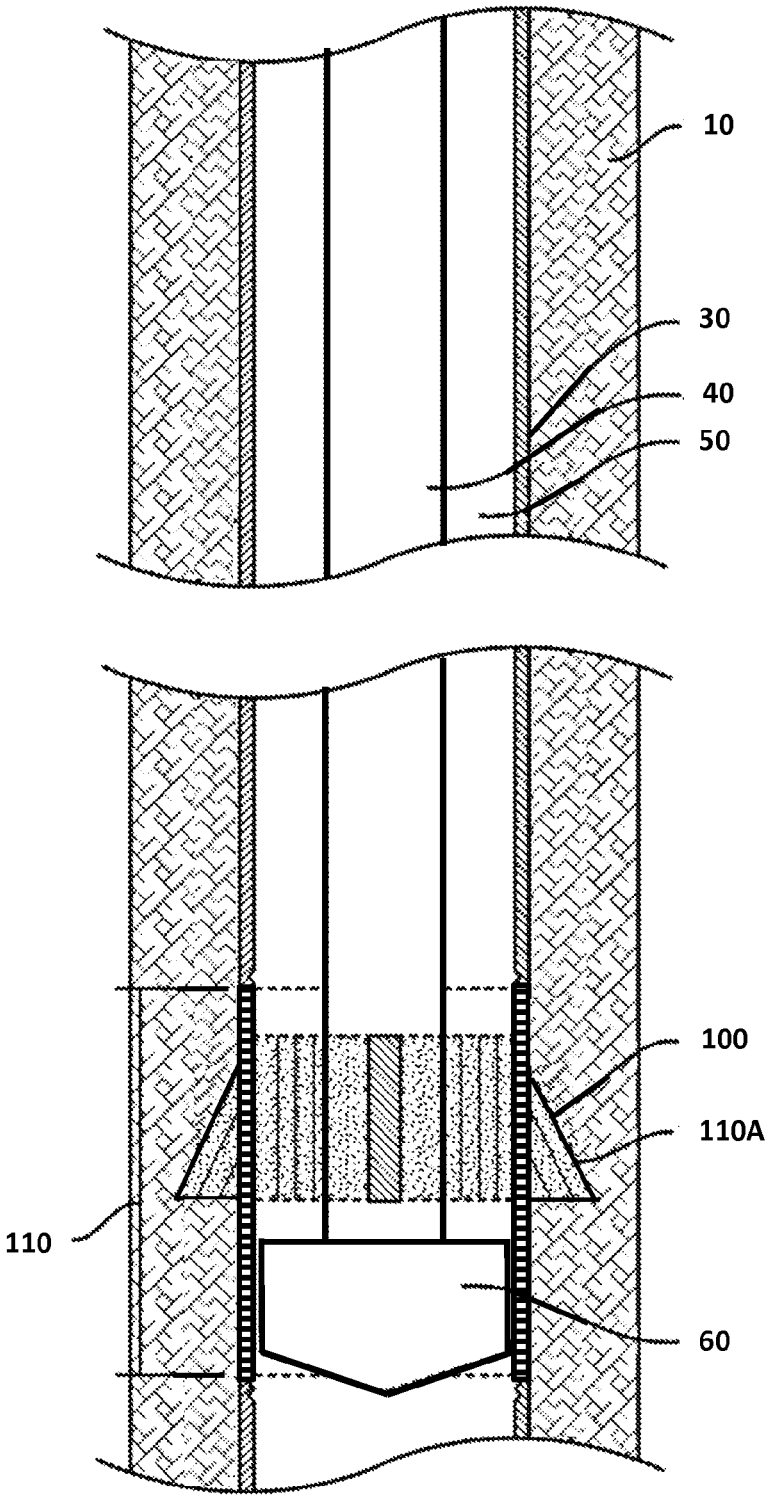
FIG. 2B illustrates a cross sectional side view of the embodiment of FIG. 2A, shown after the activator head or mandrel has activated the LBCI apparatus.

FIGS. 2A-2B, illustrates another embodiment for an LBCI apparatus 110, for jetting and piling applications. Here, the apparatus 110 can also be secured to or coupled to be integral with the conductor string 30, or positioned between or within the string 30. Further the conductor string 30 along with the installed apparatus 110 can be jetted or piled into the earth 10, thereby leaving no gap or spacing between the earth 10 and string 30. In the in-active or un-set position (FIG. 2), the apparatus 110 includes an expandable inverted cone or gusset 100. The conductor string 30 with the installed or integrated LBCI apparatus 110 can be jetted or piled to total depth and remain stationary in earth 10. In one embodiment, the LBCI setting activator head 60 can be lowered and positioned via drill pipe 40 through the inner space diameter 50 of the conductor string 30 and can be suspended or positioned above the un-set LBCI apparatus 110 in preparation for activating it or subsequently driven through the apparatus 110 to activate it.

Referring to FIG. 2B, the LBCI apparatus 110 can be activated or set by activator head 60 by running, forcing, or pushing the head 60 through the conical interior of the apparatus 110. Specifically, the LBCI apparatus 110 is set after engaging, pushing, pumping, actuating, rotating, sliding, or forcing the LBCI setting head 60 through the LBCI apparatus 110, thereby causing the inverted cone or gusset 100 to project outwards to a set or activated position 100A, thereby forming an external cone or external skirt. In the set or activated position, the reshaped apparatus 110A forms a larger cone which extends outwardly past the conductor string 30 outside diameter, thereby penetrating into the earth 10 and securing, stabilizing, and increasing the load bearing capacity of string 30.

Figure 3A:
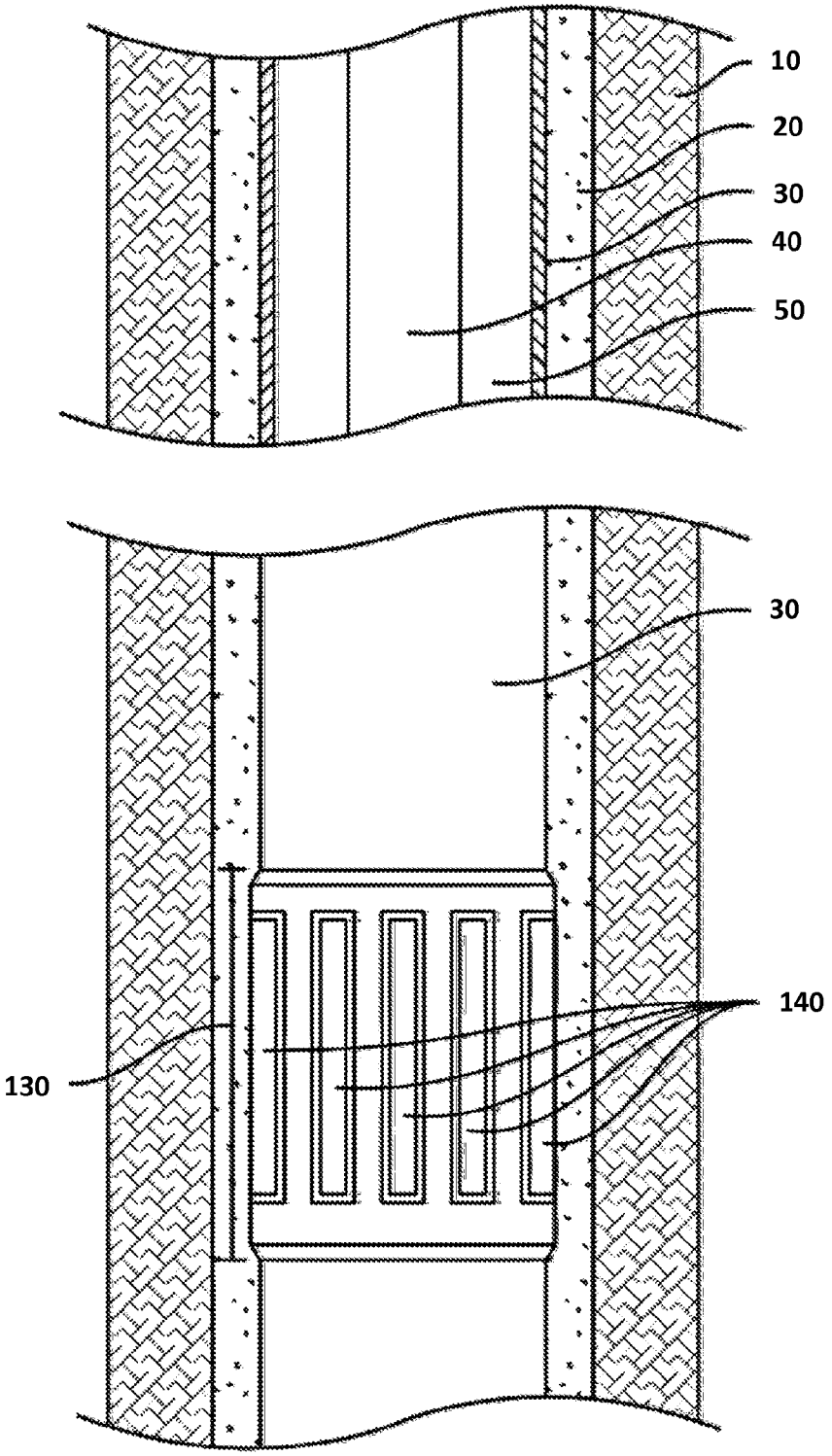
FIG. 3A illustrates a cross sectional side view of one non-limiting embodiment for a conductor string positioned in an open borehole and with another embodiment of an LBCI apparatus, shown prior to the LBCI apparatus being activated by an activator head or mandrel.
Figure 3B:
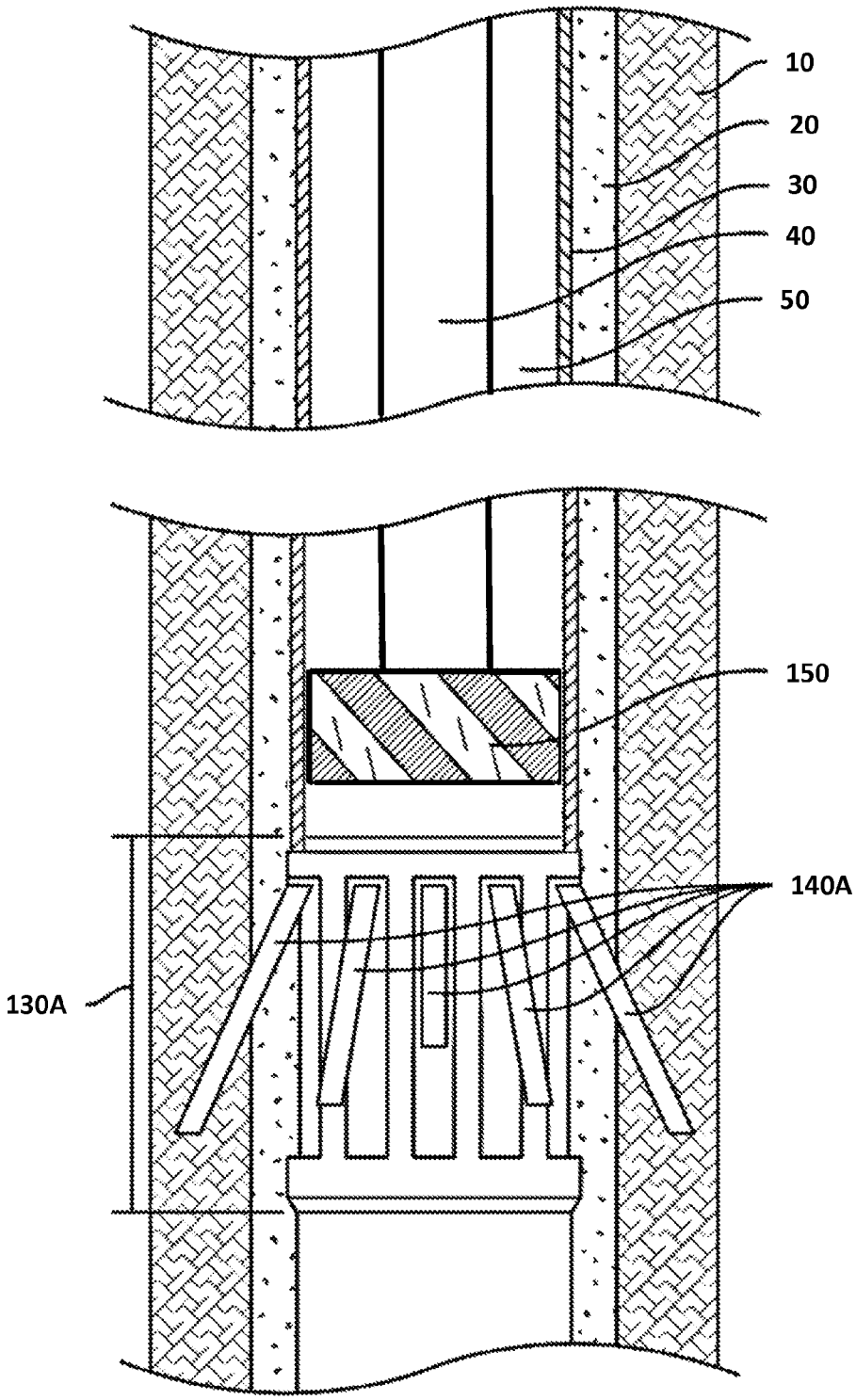
FIG. 3B illustrates a cross sectional side view of the embodiment of FIG. 3A, shown after the activator head or mandrel has activated the LBCI apparatus.

FIG. 3A-3B illustrate another embodiment for an LBCI apparatus 130 for open borehole 20 applications. Here, the apparatus 130 includes a plurality of rotating or pivoting members, spears, or rods 140 that can protrude outwards when in an activated or set position (FIG. 3B). The LBCI apparatus 130 can be joined, secured, fastened, and be integrated with the conductor string 30, either between or within string 30. Further, it can be lowered and positioned into the open borehole 20, leaving a gap or open spacing (20) between the earth 10 and conductor string 30. The conductor string 30 can be lowered, positioned, or landed at total depth and can remain stationary in the open borehole 20, which may or may not have been cemented in place yet. Prior to or after cementation (or without cementation) the LBCI setting head 60 can be lowered via drill pipe 40 through the inside diameter 50 of the conductor string 30 and can further be positioned or suspended above the un-set LBCI apparatus 130 or subsequently driven through the apparatus 130 to activate it.

FIG. 3B further illustrates the LBCI apparatus 130 in a set or activated position 130A. Specifically, the apparatus 130 can be activated after engaging, pushing, pumping, actuating, rotating, or forcing the LBCI setting head 150 through the LBCI apparatus 130 thereby causing the rods 140 to pivot, via a mechanical engagement with one or more levers coupled to the rods, and extend the rods outwardly to an active or set position 140A. When activated, the rods 140 extend outwardly past the conductor string 30 outside diameter and past the open borehole 20 gap thereby penetrating into the sides of earth 10. In addition, the outwardly extending rods 140 in their activated position 140A and their structural profile allow for fluids such as cements or gases to pass through the apparatus 130 and between the string 30 and earth 10.

Figure 4A:
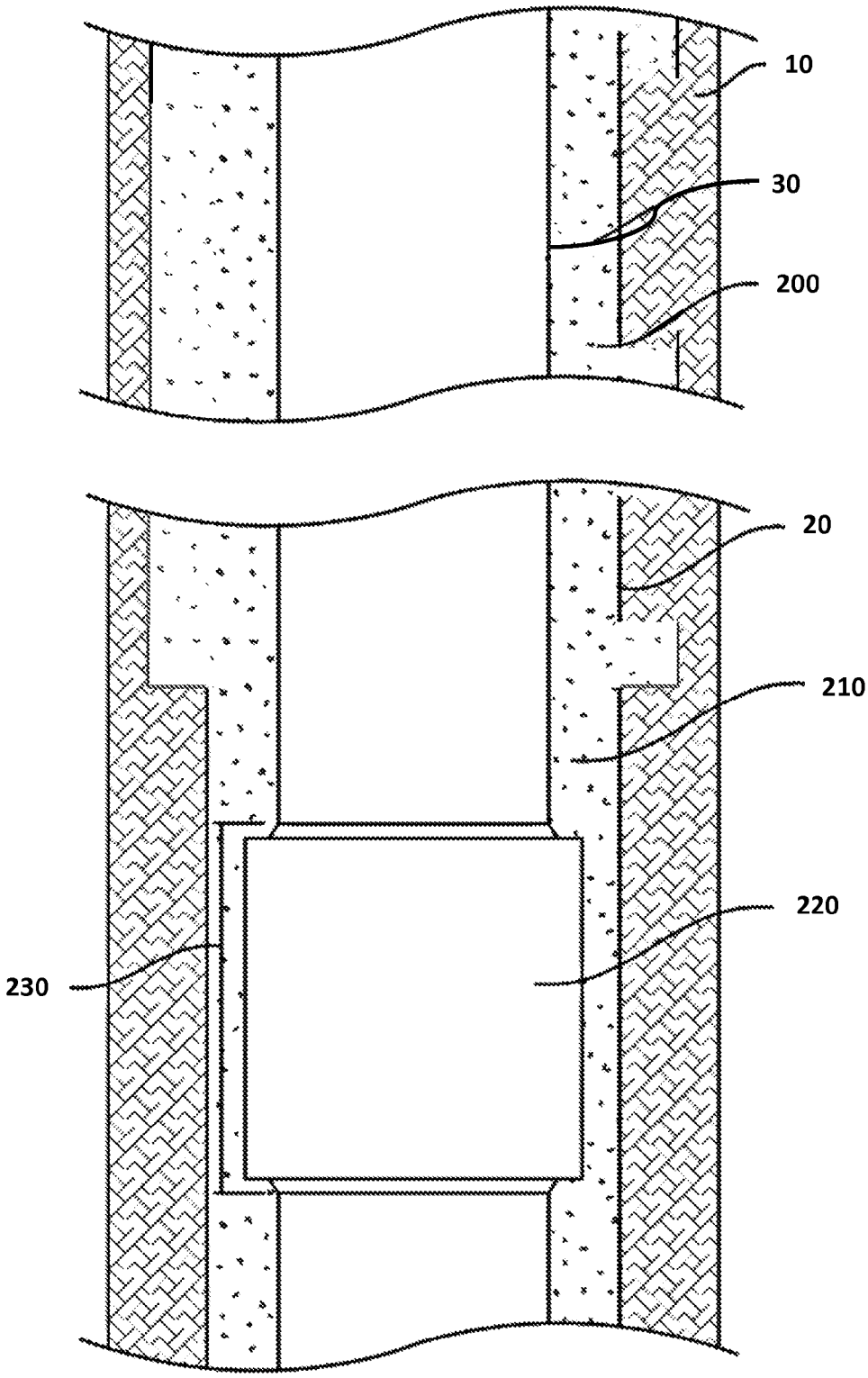
FIG. 4A illustrates a cross-sectional side view of a conductor string installed in an open borehole formed to have two different diameters, and a side view for another embodiment of an LBCI apparatus of the present invention.

FIG. 4A illustrates another embodiment for an LBCI apparatus 230 shown for open boreholes 200 and 210. In this embodiment, the LBCI apparatus 230 can remain in a fixed position without needing to be set or activated. Here, the LBCI apparatus 230 can include an outside diameter that is at least partially larger than the outside diameter of the conductor string 30. In addition, the open boreholes 200 and 210 further include two different diameters in the same combined borehole, with the smaller outside diameter open borehole 210 in the lower section of the combined open borehole and the larger outside diameter open borehole 200 in the upper section. Here, the LBCI apparatus 230 is joined, secured, fastened, or integrated to the conductor string 30 and lowered and positioned into the open borehole 200 and 210, leaving a gap or spacing between the earth 10 and conductor string 30. Here, the conductor string can be lowered, position, and landed at total depth, which for this method places the LBCI apparatus 230 in the smaller outside diameter open borehole 210 in the lower section of the combined open boreholes. In addition, the conductor string 30 with the integrated apparatus 230 can further be cemented in the open borehole 200 and 210, wherein the apparatus 230 will thereby increase the load bearing capacity of the string and borehole.

It is contemplated within the scope of the invention that any of LBCI apparatuses 70, 110, 130, and 230 can be activated or set via various means, methods, or tools. For example, the expandable members (such as members 80 and 140) can be activated via combination of gears, levers, or a mechanical operation when the activator 60 engages the members, or corresponding gears or levers. Alternatively, the projecting members of the LBCI apparatuses can be activated via an electric motor, such as servomotor or solenoid actuator, controlled by a sensor or operator via a controller from above the earth. In addition, the parts of the LBCI apparatuses can be activated via hydraulic pressure, fluid pressure, or pressurized source running through or within the LBCI apparatus. For example, the activator head can be a bladder that when filled with a fluid through a connected line it can expand within the LBCI apparatus to activate its radially outwardly protruding members. Further, an electromagnet or magnetic force can also be used to activate the projecting parts of the LBCI apparatus. In addition, the LBCI apparatuses can also be connected or secured to the conductor string via connectors, welding, or any other fastening means. In addition, there may be plurality of LBCI apparatuses installed or integrated with one or more conductor strings. Further, the LBCI apparatus of the present invention may also be used with any type of drilling operation, such as horizontal drilling, directional drilling, slant drilling, or directional boring. In addition, the LBCI apparatus of the present invention may also function as a centralizer or may not function as a centralizer. Further, the LBCI apparatus of the present invention may also increase or improve the load bearing capacity of the tubular string or borehole (whether cemented or not cemented), or both the string and borehole.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts described herein, except insofar as such limitations are included in the following claims. Further, it will be understood that certain features and sub-combinations are of utility and may be employed without reference to other features and sub-combinations.

What is claimed is:

1. A method of increasing the load bearing capacity of a tubular string, comprising:

positioning a first tubular body within a borehole, wherein the first tubular body is secured between a first substantially elongated tubular string and a second substantially elongated tubular string;

wherein a top end of the first tubular body is directly coupled to a bottom end of the first elongated tubular string, and a bottom end of the first tubular body is directly coupled to a top end of the second tubular tubular string;

wherein the first tubular body comprises a plurality of members for penetrating the earth, the members having a distal end with a tapered configuration;

wherein the first tubular body has the same inner or outer diameter with respect to the first and second elongated tubular strings;

positioning a second body within the first elongated tubular string and adjacent to the first tubular body, wherein the second body at least partially engages the first tubular body, thereby causing the members to move with respect to the first tubular body and penetrate the earth, thereby increasing the load bearing capacity of at least one of the first and second elongated tubular strings; and cementing at least one of the first and second elongated tubular strings in the borehole after the members of the first tubular body have penetrated the earth.

2. The method of claim 1, wherein the members of the first tubular body provide space between the first tubular body and the earth thereby allowing fluid to pass through the borehole around the string.

3. The method of claim 1, further comprising jetting or piling at least one of the first and second elongated tubular strings into the earth prior to the members of the first tubular body having penetrated the earth.

4. The method of claim 1, wherein the second body engages the first tubular body with one or more of: mechanical engagement, electrical engagement, and magnetic engagement.

* * * * *